United States Patent [19]

Lerman

[11] 4,211,008

[45] Jul. 8, 1980

[54] ORAL DEVICE

[76] Inventor: Martin D. Lerman, 144 Ravine Dr., Highland Park, Ill. 60035

[21] Appl. No.: 952,943

[22] Filed: Oct. 20, 1978

[51] Int. Cl.[2] ..... A61C 7/00

[52] U.S. Cl. ..... 433/229; 433/6

[58] Field of Search ..... 32/19, 14; 128/136

[56] References Cited

U.S. PATENT DOCUMENTS

| | | | |
|---|---|---|---|
| 3,385,291 | 5/1968 | Martin | 128/136 |
| 3,488,848 | 11/1970 | Lerman | 32/19 |
| 3,924,638 | 12/1975 | Mann | 128/136 |

*Primary Examiner*—Robert Peshock

*Attorney, Agent, or Firm*—Wallenstein, Spangenberg, Hattis & Strampel

[57] ABSTRACT

A device adapted to be placed in the human mouth for treating among other things temporomandibular joint dysfunctions comprising an elongated flexible plastic body having occlusal portions at the extremities thereof, the occlusal portions being interconnected at their forward or anterior ends by a labial portion. The occlusal portions each are provided with an enlarged fluid-containing passage. The passages in the occlusal portions are interconnected by a restricted passage which transverses the labial portion of the body. The occlusal portions form enlarged cells which are adapted to be positioned between the posterior teeth on each side of the mouth, and constitute occlusal pressure responsive means for hydrostatically compensating for any differences in pressure resulting from occlusal forces applied to each of the cells by the posterior teeth of the mouth. As a result, the occlusal forces which would normally be applied to the teeth are equalized and are axially oriented. The overall effect is to eliminate compensatory contraction or adjustment of the masticatory muscles, thereby enabling those muscles to function in a less strained manner, and to establish a more physiological or undistorted skull-mandible relationship.

10 Claims, 11 Drawing Figures

ORAL DEVICE

The present invention relates to a device adapted to be positioned in the human mouth for correcting masticatory muscle related stresses and/or pain due to differences in occlusal pressures along the upper and lower dental arches.

One of the most crucial factors in successful treatment of the temporomandibular joint pain-dysfunction syndrome is correction of occlusion-muscle incompatibility. Masticatory muscle accommodation, along with tension and a stress-generating type of personality, is a key factor in the etiology of this syndrome. More specifically in this connection, elevation of the mandible from a rest position into centric occlusion is probably the most frequent jaw movement. Where there is a harmonious occlusion-muscle relationship, simple elevation of the mandible is powered almost exclusively by the elevator muscles, other muscles providing only a minor bracing action. The bilateral temporals, masseters and medial pterygoids provide a massive supply of elevator motor units. Since motor units alternate in function, with fatigued units "dropping out" to rest while others take their place, simple elevation can be continued almost indefinitely without overfatiguing these muscles.

Occlusion-muscle disharmony changes this picture drastically. Accommodation has a highly selective effect on the masticatory muscles, increasing activity disproportionately in certain areas of the bilateral complex. In the presence of occlusion-muscle disharmony, atraumatic closure into centric occlusion requires that the mandible be adjusted every time it is elevated into occlusion. If, for example, the adjustment is horizontal, the muscle areas capable of producing such horizontal movements must be called into activity with the same frequency as are the elevators. Unfortunately, there are far fewer of these horizontal-adjustor motor units than elevator motor units.

Ultimately the functional capacity of these comparatively few motor units is exceeded, triggering an exhaustion-incoordination-spasm sequence and development of the temporomandibular joint syndrome "core" muscle symptoms. The resulting tenderness and spasm are found most frequently in the lateral pterygoid muscles which function as anterior adjustors of mandibular placement.

Clinical studies to date have confirmed that the sequence of muscle dysfunction spreads beyond the masticatory muscles, producing an entire constellation of primary symptoms of the temporomandibular joint pain-dysfunction syndrome. These symptoms include pain and/or tenderness in the temporomandibular joint area or masticatory muscles; "clicking" in the temporomandibular joint; limitation of jaw opening; restriction of jaw movement; and secondary symptoms which are medical in nature, being transmitted to other, more distant areas of the head and neck. These secondary symptoms probably include some of the most widespread and problematic conditions medicine has to deal with, namely, headache (including "tension" headaches, which account for 90% of all headache), atypical facial neuralgias, tinnitus, and neck and ear pain, among others. Also, certain neuromuscular disorders of the face, head and neck, shoulders, back, arms and hands can occur. These secondary symptoms are functional disturbances which exhibit no organic changes in the affected tissues, making diagnosis difficult. They are often ill-defined and difficult for the patient to describe.

These symptoms are usually diagnosed as purely medical in nature because they occur at some distance from the teeth. Their masticatory muscle origin unfortunately is not readily apparent. The usual result is that treatment is mistakenly directed to the secondary symptom's locale rather than to the underlying "invisible malocclusion." Such invisible malocclusions are common, but difficult to detect. Intercuspation of the teeth appears normal, while the underlying faulty (accommodation-necessitating) cranio-mandibular relationship is hidden by the automatic compensatory action of the muscles. The secondary symptoms resulting from temporomandibular joint dysfunction thus are usually treated palliatively instead of having their basic cause eliminated. Definitive therapy is essentially an orthopedic procedure and requires correction of the faulty cranio-mandibular relationship by a dentist.

Various of the aforementioned symptoms, and the correction thereof, are referred to in my U.S. Pat. No. 3,488,848, issued Jan. 13, 1970. The intra-oral corrective device disclosed in that patent comprises fluid containing bite portions which are connected by a separate solid palate engaging portion. While the device disclosed in that patent satisfactorily achieves the results for which it is intended, hydrostatic equalization of occlusal forces is restricted to the bite portions in which the fluid is confined. Furthermore, the use of a solid palate engaging portion creates certain discomfitures to the wearer of the device which detracts from the function it is intended to serve. In my U.S. Pat. No. 3,532,091, issued Oct. 6, 1970, various embodiments of mouth protecting devices are shown. The mouth guards disclosed in the patent utilize a fluid to hydrostatically equalize and distribute the force of blows to the mouth or jaw incurred in contact sports, for example.

In accordance with the present invention, an improved intra-oral corrective device has been evolved which effectively corrects occlusion-muscle incompatibility.

The device, in brief, comprises a thin, flexible-walled fluid-bearing cell which is worn on the upper arch. An occlusal portion rests between the posterior teeth on each side. A channel connecting the occlusal portions passes under the upper lip enabling the enclosed fluid to flow from any point within the cell to any other point therein. The fluid volume can be adjusted to obtain the desired increase in the occlusal vertical dimension. The device acts to maintain an equalizing layer of fluid between the upper and lower arches. All direct occlusal contacts are eliminated, totally eliminating the unfavorable effects of premature and displacing occlusal contacts.

Occlusal forces normally arise individually at each point of tooth-to-tooth contact. The present device causes them to arise differently, as a single perfectly equalized unit (in accordance with Pascal's law). These occlusal forces are transmitted to each tooth in contact with the occlusal portions of the device. Occlusal forces become optimal, that is, they arise simultaneously, they are perfectly equalized, and, since all horizontally displacing contacts have been eliminated, they are axially oriented. This creates a unique situation, namely, total absence of upper/lower intercuspal guidance, combined with an equalized pattern of periodontal proprioception. The equalized proprioceptive input signals the masticatory muscles that no occlusion-instigated accommodation is needed, while the absence of intercuspal guidance permits free migration of the mandible, to any position dictated by the muscles.

The compensatory redistribution of fluid within the device frees the muscles from displacing intercuspal guidance and an accommodated pattern of activity. The muscles begin to "de-accommodate." De-accommodation, if able to continue to completion, permits each muscle in the bilateral complex to regain its original and least distorted anatomic configuration, in particular, optimal alignment of origin, fiber direction and insertion, and optimal length. It is believed that during the de-accommodation process the muscles move the mandible progressively toward, and ultimately to, its most physiologic (that is, minimally accommodated) craniomandibular relationship. Centric occlusion can then be correlated to this "ideal" placement. This sequence of progressive muscle-guided mandibular placement is in sharp contrast to the single-stage clinician-directed, mandibular-placement procedures now in use.

The self-regulation of the muscles made possible by the device of this invention results in a far finer degree of muscle balance than is possible otherwise, since the sensitive neuromuscular mechanisms of feedback and adjustment are permitted to assert themselves freely. The device, therefore, is highly effective in dealing not only with the aforementioned temporomandibular joint syndrome secondary medical symptoms, but, also, with conditions that develop in response to these secondary symptoms.

In addition to its utility in correcting occlusionmuscle incompatibility, the device of the present invention also can be used as a valuable tool by dentists in the correction of malocclusional problems.

The foregoing, and other features and advantages of the device of the present invention will become apparent from the description to follow, taken in conjunction with the accompanying drawings wherein.

Figures 1, 2, 3, 4, 5, 6, 7, 8, 9, 10, 11:
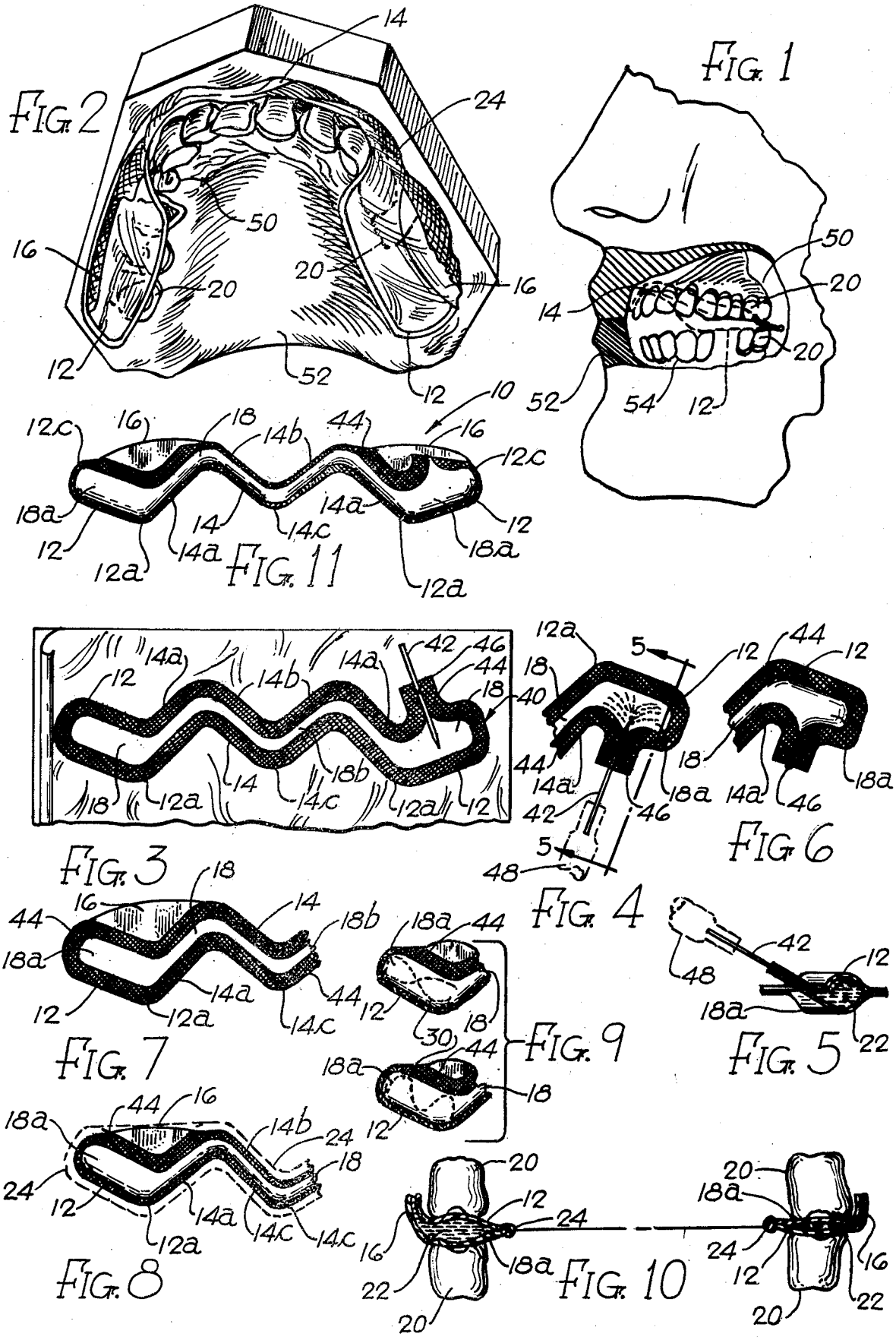
FIG. 1 is a fragmentary side view of the human mouth showing an embodiment of the device in position on the upper dental arch.
FIG. 2 is a view in perspective of said embodiment of the device positioned on the upper dental arch.
FIG. 3 is a plan view of a blank from which said embodiment is formed showing the use of a hollow needle to provide access to the fluid passageway of the device.
FIG. 4 is a fragmentary view showing the hollow needle connected to a syringe containing a fluid for injection into the passageway of the device.
FIG. 5 is a sectional view taken substantially along line 5—5 of FIG. 4.
FIG. 6 is a fragmentary view showing the needle-receiving port sealed after injection of fluid into the passageway.
FIG. 7 is a fragmentary view corresponding to the view of FIG. 7 showing a lining or bead formed along an edge of the device.
FIG. 8 is a fragmentary view corresponding to the view of FIG. 7 showing a bead or liner formed along an edge of the device.

FIG. 9 comprises two fragmentary views of the occlusal portions of the device showing a septum or supporting wall provided within said portions to prevent distortion of the occlusal portions as a result of missing posterior teeth along the areas of contact with the occlusal portions;

FIG. 10 is a fragmentary view partly in section showing the occlusal portions between the posterior teeth and illustrating hydrostatic compensation by the device for differences in occlusal pressures along each side of a dental arch; and FIG. 11 is a plan view of an embodiment of the completed device ready for use in the mouth;

Referring, now, in greater detail to the drawings, the embodiment of the device illustrated, and designated generally by reference numeral 10, comprises an elongated, flexible, unitary body having enlarged occlusal portions or cells 12—12 formed at the extremities thereof. The cells 12—12 are bridged or interconnected by a relatively narrow labial portion 14. Each inner end 14*a*—14*a* of the labial portion 14 is joined to the anterior or forward end 12*a*—12*a* of the occlusal cells 12—12. As shown, the labial portion 14, from its nexus with the forward ends 12*a*—12*a* of the cells 12—12, extends outwardly and forwardly to form curved or arcuate labial region engaging areas 14*b*—14*b* and an oppositely curved or arcuate frenum accommodating area 14*c*. A buccal region engaging portion 16 is provided along the outer edge 12*b*—12*b* of each of the cells 12—12, and advantageously extends from the inner end 12*c*—12*c* of the cells 12—12 to the outer edge of the labial region engaging areas 14*b*—14*b* of the labial portion 14, adjacent to the inner ends 14*a*—14*a* thereof.

A continuous, fluid-containing passage 18 is formed in the body of the device 10. The passage 18 is enlarged across the occlusal cells 12—12 to accommodate the wide occlusal surfaces of the posterior teeth 20 of the mouth, and to provide reservoirs 18*a*—18*a* of a fluid 22 on each side of the dental arch sufficient in volume to hydrostatically compensate for any differences in occlusal pressures exerted on the cells 12—12 by the teeth 20 while concomitantly preventing the posterior teeth from collapsing the cells 12—12. The passage 18 extends across the labial portion 14 and forms a channel 18*b* of restricted cross-section which interconnects the fluid reservoirs 18*a*—18*a* of the cells 12—12. The cross-section of the channel 18*b* of the labial portion 14 is such that it will permit the fluid 22 to move in either direction with relation to the reservoirs 18*a*—18*a* and, yet, will enable the linings of lips and gums at the labial regions of the mouth to easily and comfortably accommodate and adjust to the labial portion 14 of the device 10. In this same connection, as shown in FIGS. 2, 8 and 10 of the drawings, the edges of the occlusal portions 12—12 and the labial portion 14 most likely to come into contact with the tongue, for example, and linings of the lips and gums of the mouth, desirably are provided with a small, soft, smooth, rounded liner or bead 24 formed of a pliable, cushioning material such as a latex, polyurethane, or the like.

The fluid 22 contained in the passage 18 may be any of various unobnoxious, physiologically harmless liquids such as water, glycerine, mineral oil, or the like, and may be artificially flavored, if desired, in the event the cells 12—12 are, for some reason, punctured or ruptured, or develop a leak after prolonged use. In those instances where the device 10 is used as a diagnostic tool by a dentist, for example, to determine occlusal irregularities, or to fabricate a dental splint, the fluid 22 may be a suitable hardenable material, such as self-curing methylmethacrylate, or various well known impression materials, which will give a ready and accurate impression of the relationship of the occlusal surfaces of the posterior teeth of the upper and lower dental arches.

More specifically in this connection, the patient will bite on the occlusal portions 12—12 of the device while the substance is In a fluid, or semi-fluid, state. The closed hydraulic system of the device will enable one portion of the jaws to work against another to properly distribute and orient the hardenable material. The material will then harden. The device will provide a record of the position of the mouth when the masticatory muscles are working evenly, or will stabilize the jaw of the patient in that position when worn.

Referring, now, in particular, to FIG. 9 of the drawings, the cells 12—12 there illustrated are each provided with a vertically extending septum or inner wall 30 which may have any of various configurations. The septum or inner wall 30 acts to prevent any outward bulging of the walls of the cells 12—12 into spaces or openings resulting from missing teeth along the posterior areas of the upper and lower dental arches. The septum or inner wall 30 should be positioned in the cells in a manner so as not to interfere with or impede, the flow of fluid 22 within the passage 18. The septum or inner wall 30 may be formed of the same material of which the flexible body of the device 10 is fabricated or a different flexible material.

In accordance with the method aspects of the present invention, the device 10 advantageously is formed from a flexible plastic sheet material. A single sheet of material, folded upon itself to provide two plies of the material, may be used, or two sheets, superposed one upon the other may be employed. Apart from being flexible the sheet material should be essentially non-elongating, should have sufficient strength to be able to withstand the occlusal pressures encountered in a normal bite, should be pin-hole free, and should be chemically resistant to the physiological fluids present in the human mouth. In addition, it should be heat-sealable, and the seals formed should be capable of withstanding pressures of upwards of 300 pounds per square inch without breaking or rupturing. While a number of plastic sheet materials, exemplified by polyethylene, polypropylene, polyethylene glycol terephthalate (MYLAR), and the like, satisfy the foregoing desiderata in varying degrees, an expecially preferred material is a laminate comprised of a biaxially oriented nylon sheet material and a polyethylene-polyvinylacetate (EVA) copolymer sheet material. The thickness of the plies 32—32 of the plastic sheet material can vary from 2 or 3 mils to about 10 mils. In the case of the aforementioned nylon-EVA copolymer laminate, the thickness of the laminate can range from 3 to 5 mils to about 8 to 10 mils, with a range of 6 to 7 mils being preferred. The nylon sheet material, generally speaking, will comprise from about 10% to about 50%, usually about 20% to about 30%, of the thickness of the laminate.

Conventional heat sealing equipment such as an electronic heat sealing press, can be utilized to form the device of the present invention. In accordance with a preferred practice of carrying out the method, a plurality of blanks 40, see FIG. 3, are formed simultaneously in a single heat sealing operation. The individual blanks 40 may then be die-cut to separate them from the sheet material. As shown in FIGS. 3 through 6 of the drawings, a hollow object, such as a needle 42, desirably is positioned between the plies 32—32 of sheet material prior to sealing. The needle 42 serves to interrupt the otherwise continuous seal 44 formed by the heat sealing press, and provides an access port 46 to the passage 18 formed when the plies 32—32 are heat sealed. The needle 42 serves as an effective means for evacuating any residual air entrapped in the passage 18 during heat-sealing, and, more importantly, enables the desired amount of fluid 22 to be injected from a syringe 48, for example, attached to the needle 42, into the passage 18 to form the fluid reservoirs 18*a*—18*a* in the cells 12—12, and to fill the channel 18*b* in the labial portion 14.

After the fluid 22 is introduced into the passage 18, the needle 42 is partly removed from the access port 46, and the port 46 is sealed off at a point below the tip of the needle. The needle 42 is then completely removed for re-use.

Heat sealing of the plies 32—32 of plastic sheet material can be carried out in a partial vacuum, or the plies may be passed between rollers prior to sealing, to eliminate any entrapped air between the sheets. Again, in the case where the device is to function as a diagnostic aid for determining occlusal irregularities, the inner surface of each ply of sheet material forming the cells 12—12 may for instance, be coated with a dye which will provide an accurate record of any such irregularities when the occlusal surfaces of the teeth move the dye coated surfaces into contact with one another.

In FIGS. 1 and 2 of the drawings, the device 10 is shown in position along the upper dental arch 50 of the human mouth 52. It should be understood, of course, that the device can be positioned as well along the lower dental arch 54. When the device is in position, the cells 12—12 are located between the occlusal surfaces of the posterior teeth of the upper and lower dental arches. The labial portion 14 lies between the inner surface of the upper lip and the outer surface of the upper gum, at, or slightly above, the base of the front teeth. The buccal portion 16 is positioned between the inner lining of the cheeks and the gum adjacent to the lateral surfaces of the posterior teeth. The buccal portion 16 thus acts, in cooperation with the inner surface of the cheek, to urge the cells 12—12 in a direction which maintains the cells 12—12 between the occlusal surfaces of the posterior teeth (see FIG. 1).

As shown in FIG. 10, the occlusal surfaces of the teeth on one side are closer together than the occlusal surfaces of the teeth on the other side. This malocclusion may be the result of any of a number of factors. If the malocclusion is not treated, the muscles of mastication on one side of the jaws attempt compensatory contraction or adjustment which in many cases, gives rise to pain or other symptoms. The device 10 of the present invention compensates for the malocclusion and equalizes the occlusal forces exerted against the upper and lower posterior teeth of the dental arches. Thus, as seen in FIG. 10, as the mandible closes, the teeth on each side of the dental arches make contact with the flexible occlusal cells 12—12. Any differences in occlusal pressure exerted by the teeth on either side of the dental arches will result in the flow of fluid 22 in the passage 18 in a direction to hydrostatically compensate for any such differences. Since the fluid 22 will flow until the pressure exerted by the fluid within the passage 18 is uniformly distributed therearound, the pressures exerted by the cells 12—12 against the occlusal curve are equalized, and no compensatory adjustment is required by the masticatory muscles.

While the invention has been illustrated and described in relation to a specific embodiment thereof, it should be understood that various modifications may be made in the device without departing from the spirit and scope of the invention.

What is claimed is:

1. A device adapted to be placed in the human mouth for treating among other things temporomandibular joint dysfunctions comprising: an enlongated, flexible body having a continuous fluid-containing passage therein, said body including occlusal portions at the extremities thereof adapted to be positioned between the posterior teeth on each side of the mouth, the fluid-containing passage of the body being enlarged along substantially the entire length of the occlusal portions to provide occlusal pressure responsive means in the body for hydrostatically compensating for differences in pressure resulting from occlusal forces applied thereto by the posterior teeth of the mouth, and a labial portion for the body having a fluid-containing passage in communication with the enlarged fluid-containing passage in each of the occlusal portions of the body, said labial portion being joined at its ends to the forward end of each of the occlusal portions of the body and extending outwardly and laterally thereof, said labial portion being shaped to enable it to be comfortably received along the labial regions of the mouth, the fluid-containing passage of the labial portion being of reduced cross-section along substantially the entire length thereof to enable the labial regions of the mouth to easily conform to the labial portion of the body while permitting ready flow of fluid between the occlusal portions of the body to be achieved whereby any differences in the occlusal forces exerted by the posterior teeth can be readily hydrostatically equalized.

2. A device according to claim 1 wherein buccal engaging means is provided along an edge of each of the occlusal portions, said means in response to pressure along the buccal regions of the mouth acting to maintain the occlusal portions between the posterior teeth of the upper and lower dental arches.

3. A device according to claim 1 wherein the lingual contacting edges of the occlusal portions of the device are provided with cushioning means to prevent any irritation to the tongue by the device during use.

4. A device according to claim 1 wherein cushioning means is provided along at least one edge of the labial portion of the device.

5. A device according to claim 1 wherein the labial portion is curved in a manner to accommodate the frenum along the labial regions of either the upper or lower dental arches.

6. A device according to claim 1 wherein the occlusal portions of the device are each provided with an inner wall within the fluid-containing passage thereof, said inner wall serving to prevent distortion of the walls of the occlusal portions due to the presence of unnatural spaces between adjacent posterior teeth.

7. A device according to claim 1 wherein the continuous fluid-containing passage is bordered by a fluid-tight heat seal.

8. A method of making an intra-oral corrective device for treating temporomandibular joint dysfunctions comprising: providing two plies of a sealable plastics material, inserting between said plies means for providing access to any unsealed areas of the plies, sealing the plies to provide a blank having occlusal engaging portions, an interconnecting labial portion and a continuous fluid receiving passageway, introducing a fluid into the passageway through said means, and removing said means from between the plies and sealing off the passageway.

9. A method according to claim 8 wherein said means is a hollow needle is inserted between the plies prior to sealing, and a source of fluid is attached to the needle for introducing fluid into the passageway.

10. A method according to claim 9 wherein the needle, after fluid is introduced into the passageway, is partly withdrawn and the passageway is sealed-off by sealing the plies at a point below the tip of the needle.

* * * * *